US006817688B2

(12) United States Patent
O'Halloran

(10) Patent No.: US 6,817,688 B2
(45) Date of Patent: Nov. 16, 2004

(54) MOUNTING ASSEMBLY FOR A REFRIGERATOR STORAGE DRAWER

(75) Inventor: Jeffrey O'Halloran, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 47 days.

(21) Appl. No.: 10/379,730

(22) Filed: Mar. 6, 2003

(65) Prior Publication Data

US 2004/0174107 A1 Sep. 9, 2004

(51) Int. Cl.[7] ..... A47B 96/06

(52) U.S. Cl. ..... 312/404; 312/408; 108/108; 248/250

(58) Field of Search ..... 312/404, 401, 312/408, 410, 351; 108/108, 42, 47; 248/250, 235, 220.21, 220.41, 220.42

(56) References Cited

U.S. PATENT DOCUMENTS 4,666,117 A * 5/1987 Taft ..... 248/250
4,732,358 A * 3/1988 Hughes et al. ..... 108/108
4,830,323 A * 5/1989 Harley ..... 248/250
5,403,083 A 4/1995 Dasher et al.
5,456,435 A 10/1995 Sweeney
5,540,493 A * 7/1996 Kane et al. ..... 312/408
5,641,217 A 6/1997 Caruso et al.
6,170,276 B1 1/2001 Madnel et al.

* cited by examiner

*Primary Examiner*—Anthony D. Barfield
(74) *Attorney, Agent, or Firm*—Diederiks & Whitelaw, PLC

(57) ABSTRACT

A mounting assembly for a refrigerator storage drawer includes various plastic mounting brackets having multiple hooks for engaging slots in a refrigerator shelf ladder. Each mounting bracket also includes a protrusion for snap-locking the mounting bracket on the shelf ladder. Further, each mounting bracket includes various legs extending outwardly so as to define a slot into which a drawer frame is positioned such that the drawer frame is cantilevered from cooperating ones of the mounting brackets. The storage drawer is slidably mounted within the drawer frame.

19 Claims, 4 Drawing Sheets

MOUNTING ASSEMBLY FOR A REFRIGERATOR STORAGE DRAWER

BACKGROUND OF THE INVENTION

1. Field of the Invention

The present invention pertains to the art of refrigerators and, more particularly, to an assembly for supporting a storage drawer in a refrigerator.

2. Discussion of the Prior Art

In the art of refrigerators, particularly household refrigerators, it is often desirable to have a temperature controlled storage drawer to enhance the preservation of different food items. The temperature controlled storage drawer generally takes the form of a slidable bin which is sealed to maintain a relatively high humidity level, while the bin is chilled to establish a desirable temperature within the bin. The temperature controlled storage drawer fits within a housing that is often supported by grooves or rails molded in a refrigerator compartment liner. In addition, some refrigerators include a pantry drawer located below the temperature controlled storage drawer. Therefore, the refrigerator compartment liner must include grooves or rails for two drawer housings. Since some refrigerators include pantry drawers and some do not, it is desirable to have a refrigerator compartment liner that may be used in either a refrigerator with or without the pantry drawer, while maintaining an appealing appearance in the liner.

Attempts have been made to attach a drawer to a shelf ladder located along a back portion of the refrigerator liner. For example, U.S. Pat. No. 5,641,217 discloses a drawer assembly which may be moved to various positions within the refrigerator cabinet. The drawer is slidably mounted to a pair of rails which are removably fixed to the underside of a cantilevered shelf. The shelf is supported by brackets which matingly engage a set of slots in a pair of spaced steel shelf ladders extending vertically along the back of the refrigerator compartment. Each of the brackets includes a hook and a centering guide for engaging the respective shelf ladder and supporting the shelf. One drawback of this assembly is that the drawer simply hangs below the shelf and does not include a housing. In addition, the bracket may be knocked out of position because there is no mechanism for locking the bracket and shelf in place.

There are also drawbacks associated with attaching a temperature controlled storage drawer frame to a shelf ladder with hooks normally used to support shelves. The hooks may disengage from the shelf ladder if a large amount of upward force is applied onto the hooks by the drawer frame. When loaded refrigerator storage drawers are opened and there is nothing on top of the drawer frame to counterbalance the load, the frame may rotate upwards in the rear, thereby disengaging the hooks from the shelf ladder. Based on the above, there exists a need for an enhanced refrigerator storage drawer mounting assembly which is versatile, aesthetically appealing, and effective in locking into place and preventing a drawer frame from tipping in the rear and falling out of the refrigerator cabinet, while allowing the storage drawer and frame to be readily moved to various levels within the refrigerator cabinet.

SUMMARY OF THE INVENTION

The present invention is directed to a mounting assembly for a refrigerator storage drawer, which may be separately, temperature and/or humidity controlled. In accordance with the invention, the mounting assembly includes a plastic mounting bracket having hooks for engaging slots in a refrigerator shelf ladder. The mounting bracket also includes a protrusion for engaging a second slot on the shelf ladder. This additional protrusion prevents the bracket from becoming disengaged, due to an upward force, when the temperature controlled storage drawer is in an open position. The storage drawer is positioned within a frame which is supported by outwardly extending legs of the mounting bracket. As a refrigerator typically includes two or three shelf ladders, the drawer is preferably supported by two or more mounting brackets.

Additional objects, features and advantages of the present invention will become more readily apparent from the following detailed description of a preferred embodiment when taken in conjunction with the drawings, wherein like reference numerals refer to corresponding parts in the several views.

DETAILED DESCRIPTION OF THE PREFERRED EMBODIMENT

Figure 1:
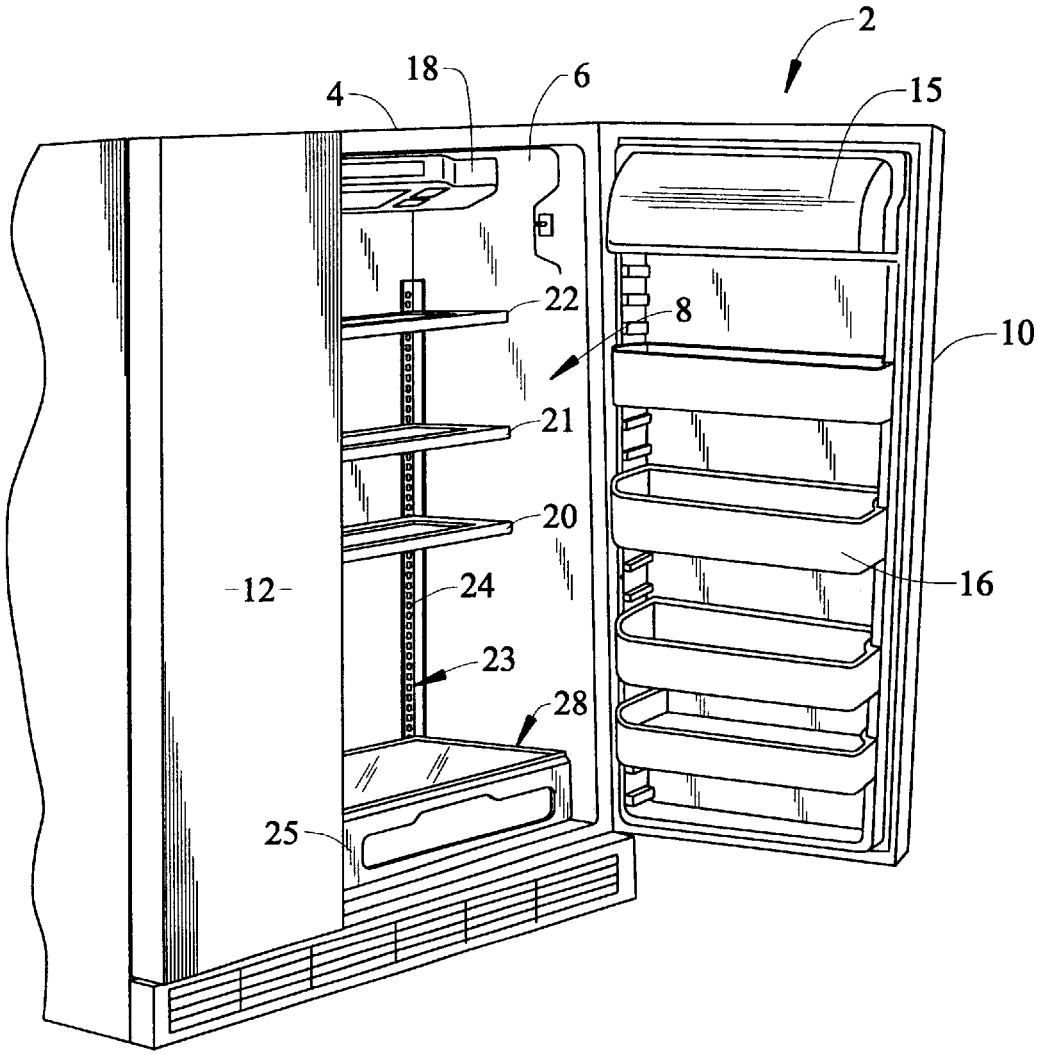
FIG. 1 is a partial, front perspective view of a side-by-side refrigerator incorporating the mounting assembly of the present invention in the fresh food compartment thereof.

With initial reference to FIG. 1, a refrigerator cabinet 2 includes a shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a freezer compartment (not shown). For the sake of completeness, refrigerator cabinet 2 is shown to include, on door 10, a dairy compartment 15 and various vertically adjustable shelving units, one of which is indicated at 16. Mounted in an upper area of fresh food compartment 8 is a temperature control housing 18 for regulating the temperature in both fresh food compartment 8 and the freezer compartment. Further illustrated for exemplary purposes is a plurality of shelves 20–22 which are cantilevered from spaced shelf ladders, one of which is indicated at 23. Each shelf ladder 23 is formed with a plurality of vertically spaced apertures 24. At a lowermost portion of fresh food compartment 8 is a temperature controlled storage drawer 25. It should be noted that a wide range of storage drawers with the same or different configurations may be used with the present invention even though all further references will be made to storage drawer 25.

Figure 2:
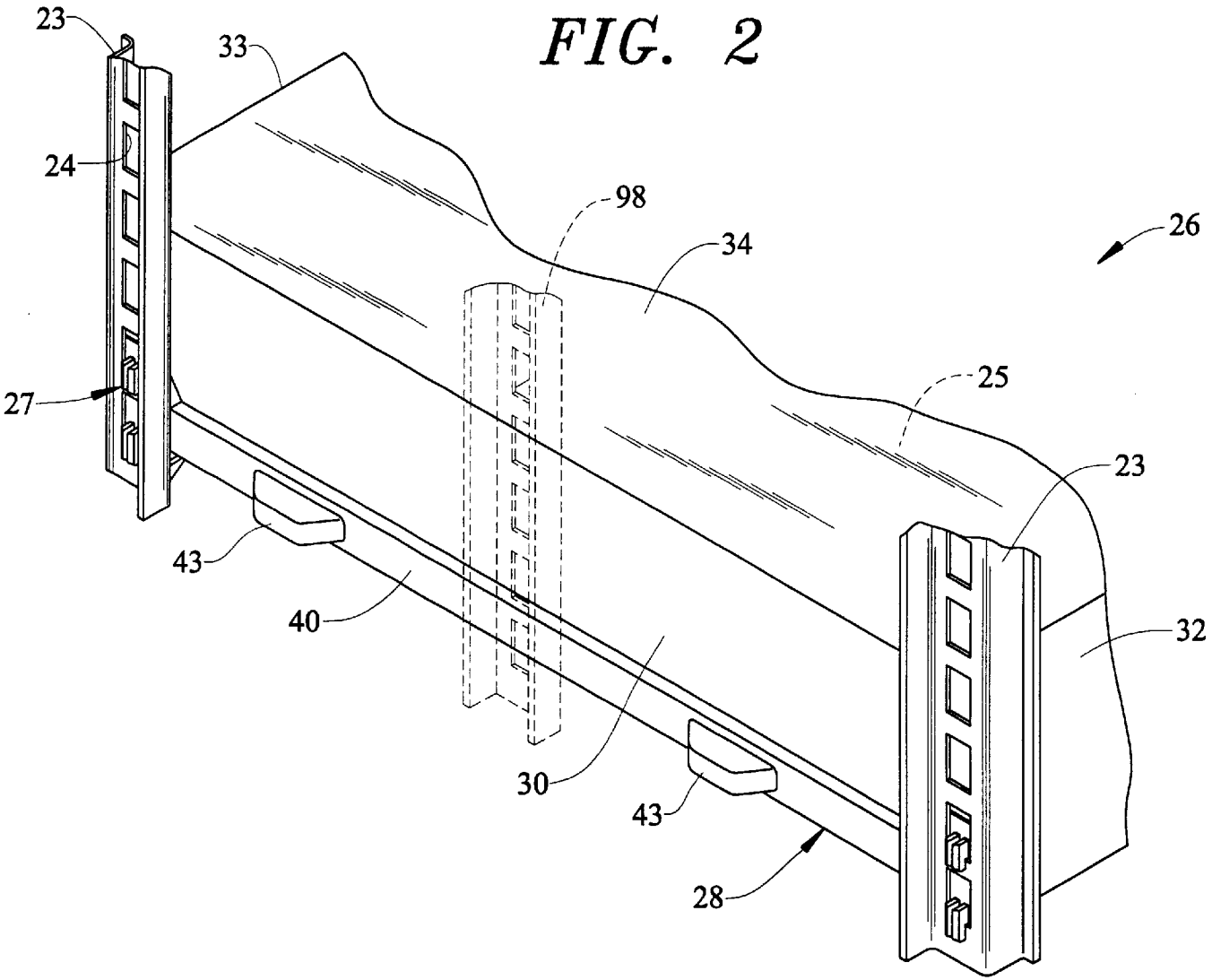
FIG. 2 is a rear perspective view of the mounting assembly of the invention.

The present invention is particularly directed to the mounting of storage drawer 25 in fresh food compartment 8. As shown in FIG. 2, a mounting assembly 26 in accordance with the invention includes at least one shelf ladder 23, a mounting bracket 27, a drawer frame 28, and storage drawer 25. Storage drawer 25 fits within drawer frame 28, which is supported by mounting bracket 27 upon each shelf ladder 23. Drawer frame 28 includes a back surface 30, sides 32 and 33, top surface 34, and a bottom surface (not shown).

Back surface 30 includes a ridge 40 or rail which extends laterally across back surface 30 of frame 28. Ridge 40 can include swells 43 extending rearwardly from back surface 30.

Figure 3:
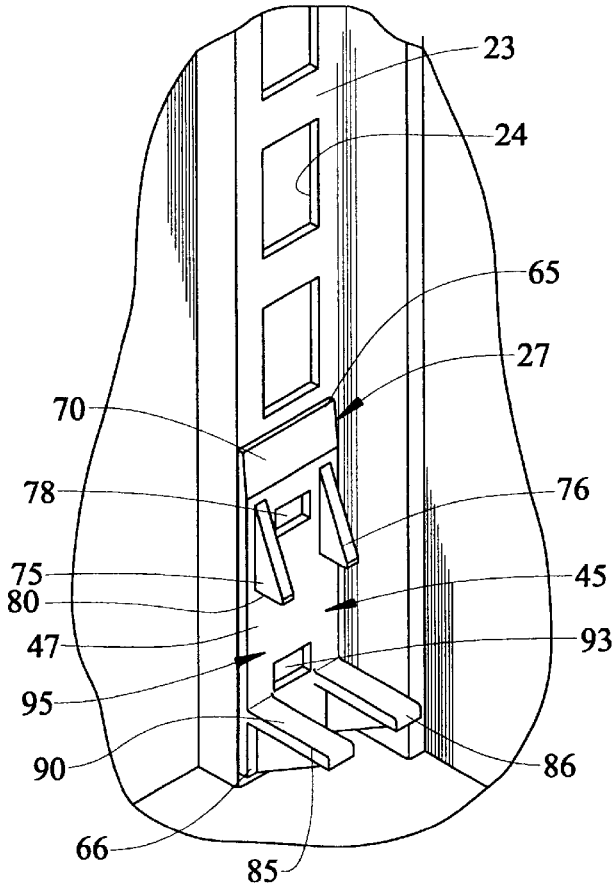
FIG. 3 is a front perspective view showing a bracket of the mounting assembly of the invention attached to a shelf ladder.
Figure 4:
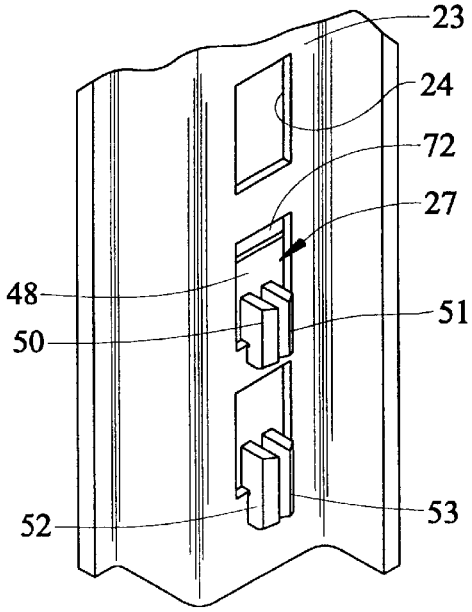
FIG. 4 is a rear view of the bracket mounting arrangement of FIG. 3.
Figure 5:
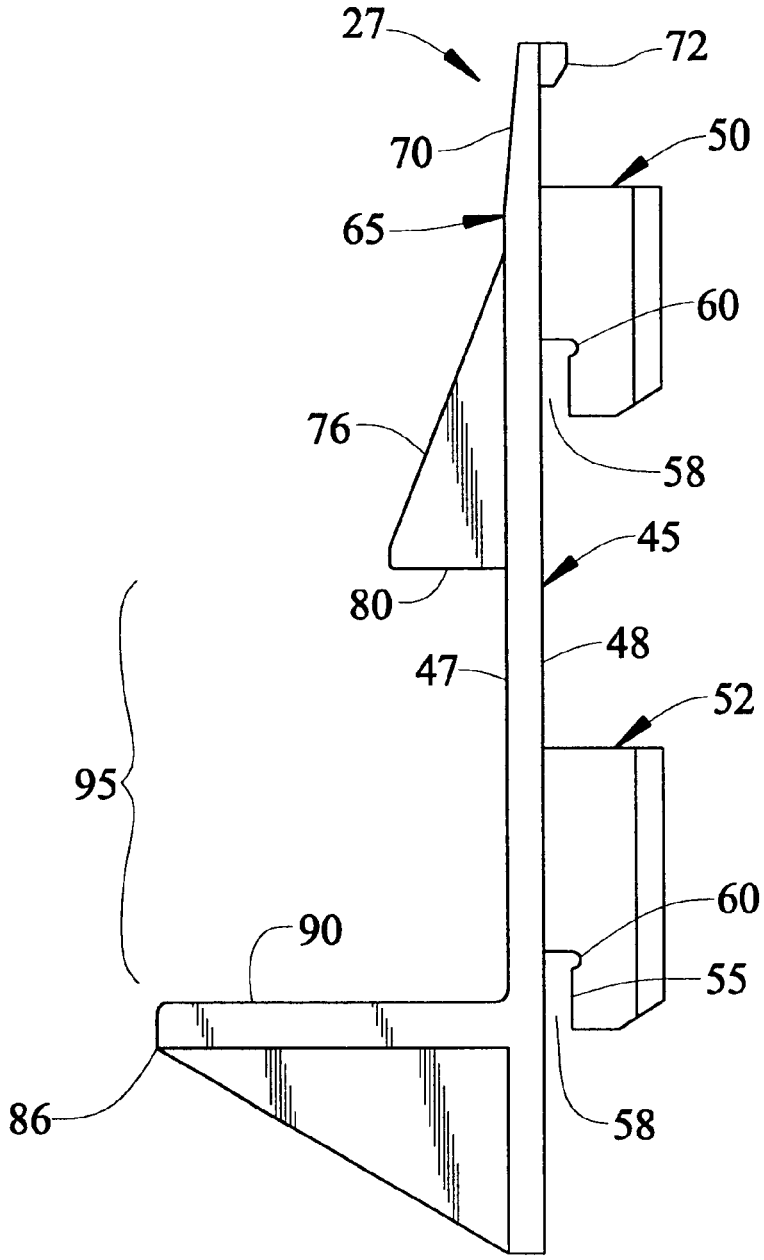
FIG. 5 is a side view of the bracket illustrated in FIG. 3.

As illustrated in FIGS. 3–5, mounting bracket 27 includes a main body 45 in the form of a plate having a front surface 47 and a back surface 48. Mounting bracket 27 is preferably integrally formed of plastic. Back surface 48 includes rearwardly extending hooks 50-53, with each hook 50–53 including an engaging portion 55 and a slit or gap 58 formed between back surface 48 and engaging portion 55. Formed within engaging portion 55 and exposed to slit 58 is an indent 60. Indent 60 helps relieve stress placed on each of hooks 50–53 when mounting bracket 27 is in use. As shown, hooks 50 and 51 are preferably spaced apart and parallel to each other. Similarly, hooks 52 and 53 are arranged spaced apart and parallel.

Front surface 47 of mounting bracket 27 includes an upper end 65 and a lower end 66. Upper end 65 includes a tapered portion 70. Behind tapered portion 70, preferably at an uppermost portion of mounting bracket 27, is provided a projection 72 (particularly see FIG. 5). Located below tapered portion 70, along front surface 47, are upper legs 75 and 76, which are spaced apart from each other and extend substantially perpendicular from front surface 47. A first hole or indentation 78 is formed in body 45 between upper legs 75 and 76. Each 25 of upper legs 75 and 76 includes a substantially flat bottom surface 80 for contacting ridge 40 of drawer frame 28 as will be further discussed below.

At lower end 66 of mounting bracket 27, a pair of spaced lower legs 85 and 86 extent outwardly, substantially perpendicular to front surface 47. Preferably, lower legs 85 and 86 extend further outward from front surface 47 than upper legs 75 and 76, as clearly shown in FIGS. 3 and 5. Each of lower legs 85 and 86 includes an upper surface 90 for supporting ridge 40 of drawer frame 28. A second hole or indentation 93 is formed in body 45 above lower legs 85 and 86. With this arrangement, upper legs 75 and 76 and lower legs 85 and 86 form a slot 95 therebetween.

During use, each mounting bracket 27 is initially positioned within refrigerator cabinet 2, such that hooks 50 and 51 extend through one aperture of the plurality of apertures 24 of shelf ladder 23 and hooks 52 and 53 extend through a second aperture of the plurality of apertures 24. Mounting bracket 27 is then pushed downward until engaging portion 55 of each hook 50–53 is positioned behind shelf ladder 23. At the same time, projection 72 snap locks into the uppermost portion of the same aperture 24 that hooks 50 and 51 are received. With this arrangement, mounting bracket 27 is positively retained upon ladder 23. Thereafter, another mounting bracket 27 is then attached at a similar height to the opposing shelf ladder 23.

Once at least a pair of mounting brackets 27 are secured in position in the manner set forth above, drawer frame 28 is mounted to the mounting brackets 27. More specifically, drawer frame 28 is maneuvered such that ridge 40 is received in the slots 95 of the mounting brackets 27. When ridge 40 of drawer frame 28 is inserted into each slot 95, upper surface 90 of each lower leg 85, 86 supports a portion of the weight of frame 28 in a cantilevered manner. At this time, swells 43 can abut liner 6. Once frame 28 is securely positioned in refrigerator cabinet 2, storage drawer 25 may be inserted into drawer frame 28 and will also be supported by mounting bracket 27. When mounted in this fashion, bottom surface 80 of each upper leg 75 and 76 prevents frame 28 and drawer 25 from tipping.

Although described with reference to a preferred embodiment of the invention, it should be readily understood that various changes and/or modifications can be made to the invention without departing from the spirit thereof. For instance, refrigerator cabinet 2 may include supports (not shown) for engaging sides 32 and 33 of frame 28 to limit any potential lateral shifting. On the other hand, mounting brackets 27 and ridge 40 could include cooperating structure to limit any lateral shifting as well. Furthermore, an additional central ladder 98 (see FIG. 2) could also be employed to support drawer frame 28 with another mounting bracket (not shown) or to enable laterally adjacent drawers to be mounted within the refrigerator. Alternatively, a single mounting bracket 27 can be utilized with only a single central ladder 98, without the use of side ladders 23. In this embodiment, supports (not shown) may be utilized to provide additional stability to drawer frame 28. In any case, with the refrigerator storage drawer mounting arrangement of the invention, a storage drawer 25 can be readily supported in a select vertical position upon ladders 23 generally only employed to support shelves. Mounting bracket 27 are preferably formed with the spaced hooks 50–53 to enhance use with various known refrigerator shelf ladders or rails. However, the number of hooks 50–53 could certainly vary, for instance, hooks 52 and 53 need not actually be present. Although ridge 40 is shown to include a single member protruding from a lowermost rear portion of drawer frame 28, a series of separate ridge members and/or higher mounting locations could be employed. Finally, although refrigerator 2 is depicted as a side-by-side model, it should be readily apparent that the invention can also be employed in other refrigerator models, including top and bottom mount styles. In any event, the invention is only intended to be limited by the scope of the following claims.

I claim:

1. A refrigerator comprising:

a cabinet shell defining a refrigerated compartment having a rear wall;

a pair of spaced ladders mounted adjacent the rear wall, each of the ladders including a plurality of vertically spaced apertures;

a plurality of mounting brackets, each of said mounting brackets including a body having a front surface and a back surface, at least one hook extending from the back surface of the body for suspending the mounting bracket to a respective one of the ladders, and upper and lower legs extending from the front surface of the body, said upper and lower legs being spaced so as to define a slot therebetween;

a drawer frame having a back surface with a protruding ridge, said protruding ridge being positioned in the slots of at least two of the plurality of mounting brackets suspended on the pair of spaced ladders such that the drawer frame is supported by the at least two mounting brackets within the refrigerated compartment; and a storage drawer slidably supported by the drawer frame.

2. The refrigerator according to claim 1, wherein each of the mounting brackets is integrally formed of plastic.

3. The refrigerator according to claim 1, wherein each of the mounting brackets includes at least two hooks extending from the back surface of the body for suspending the mounting bracket to the respective one of the ladders.

4. The refrigerator according to claim 3, wherein the two hooks are vertically spaced along the back surface and extend through distinct ones of the plurality of vertically spaced apertures.

5. The refrigerator according to claim 3, wherein the two hooks are arranged laterally spaced along the back surface and extend through a common one of the plurality of vertically spaced apertures.

6. The refrigerator according to claim 1, wherein each of the mounting brackets is further provided with a projection extending from the back surface, said projection extending into a respective one of the apertures to snap-lock the mounting bracket in place.

7. The refrigerator according to claim 6, wherein the projection extends into a different one of the plurality of vertically spaced apertures than the at least one hook.

8. The refrigerator according to claim 1, wherein each of the mounting brackets includes a pair of laterally spaced upper legs and a pair of laterally spaced lower legs, said slot being defined between the pair of upper legs and the pair of lower legs.

9. The refrigerator according to claim 1, wherein the protruding ridge is provided along a lower rear portion of the drawer frame.

10. The refrigerator according to claim 1, further comprising: at least one swell projecting from the back surface of the drawer frame for abutting the rear wall of the refrigerated compartment.

11. The refrigerator according to claim 10, wherein the at least one swell projects from the protruding ridge.

12. A method for supporting a storage drawer in a refrigerator compartment having first and second laterally spaced ladders each with a plurality of vertically spaced apertures comprising the steps of:

positioning a first hooking member extending from a rear portion of a first mounting bracket in one of the plurality of apertures in the first ladder at a first level in the refrigerator compartment;

sliding the first mounting bracket relative to the first ladder to force a portion of the first hooking member behind the first ladder to attach the first mounting bracket to the first ladder;

positioning a second hooking member extending from a rear portion of the second mounting bracket in one of the plurality of apertures in the second ladder at the first level within the refrigerator compartment;

sliding the second mounting bracket relative to the second ladder to force a portion of the second hooking member behind the second ladder to attach the second mounting bracket to the second ladder;

inserting a ridge protruding from a back surface of a drawer frame into a slot defined by spaced apart legs provided on a front portion of each of the first and second mounting brackets in order to cantilever the drawer frame from the first and second mounting brackets within the refrigerator compartment; and slidably mounting a storage drawer to the drawer frame.

13. The method of claim 12, wherein the first mounting bracket is mounted to the first ladder through a pair of first hooking members and the second mounting bracket is mounted to the second ladder through a pair of second hooking members.

14. The method of claim 13, wherein the pair of first hooking members is mounted in said one of the plurality of apertures.

15. The method of claim 13, wherein the pair of first hooking members is mounted in two distinct ones of the plurality of apertures.

16. The method of claim 12, further comprising: snap-locking the first mounting bracket to the first ladder by positioning a projection extending from the rear portion of the first mounting bracket into a respective one of the plurality of apertures upon sliding the first mounting bracket relative to the first ladder.

17. The method of claim 16, wherein the projection extends into a different aperture than the first hooking member.

18. The method of claim 12, wherein the drawer frame is cantilevered from the first and second mounting brackets at a lower rear portion of the drawer frame.

19. The method of claim 12, further comprising: positioning at least one swell, extending from the back surface of the drawer frame, against a wall of the refrigerator compartment.

* * * * *